US008344954B2

(12) United States Patent
Cheng et al.

(10) Patent No.: US 8,344,954 B2
(45) Date of Patent: Jan. 1, 2013

(54) ANTENNA

(75) Inventors: Shih-Chieh Cheng, Tainan County (TW); Kuo-Chang Lo, Miaoli County (TW)

(73) Assignee: Arcadyan Technology Corporation, Hsinchu (TW)

( * ) Notice: Subject to any disclaimer, the term of this patent is extended or adjusted under 35 U.S.C. 154(b) by 563 days.

(21) Appl. No.: 12/564,977

(22) Filed: Sep. 23, 2009

(65) Prior Publication Data

US 2010/0073240 A1 Mar. 25, 2010

(30) Foreign Application Priority Data

Sep. 23, 2008 (TW) ..... 97136487 A

(51) Int. Cl.
*H01Q 1/24* (2006.01)
*H01Q 1/38* (2006.01)

(52) U.S. Cl. ..... 343/702; 343/846

(58) Field of Classification Search ..... 343/700 MS, 343/702, 846; 455/575.7
See application file for complete search history.

(56) References Cited

U.S. PATENT DOCUMENTS 6,985,114 B2 * 1/2006 Egashira ..... 343/702
7,026,996 B2 * 4/2006 Harano ..... 343/700 MS

* cited by examiner

*Primary Examiner* — Michael C Wimer
(74) *Attorney, Agent, or Firm* — WPAT PC; Justin King

(57) ABSTRACT

An antenna is disclosed, which comprises: a substrate with a first surface and a second surface; a first radiation unit, disposed on the first surface; an insulating unit, disposed on the first surface on top of the first radiation unit; a first feed point, formed on the second surface and electrically connected to the first radiation unit; a grounding unit, disposed coplanar and connected with the first radiation unit; a first gap, formed between the first radiation unit and the grounding unit; and a second feed point, formed on the second surface and electrically connected to the grounding unit; wherein, as the second surface with the two feed points disposed thereon is adjacent to at least a metallic component and the radiation units are disposed on the first surface, the radiation units do not directly face the metallic component and thus prevent the same from being interfered by metallic shielding.

19 Claims, 3 Drawing Sheets

ANTENNA

BACKGROUND OF THE INVENTION

1. Field of the Invention

The present invention generally relates to an antenna and, more particularly, to an antenna with feed points disposed on a second surface of the substrate and radiation units disposed on a first surface of the substrate.

2. Description of the Prior Art

Since electronic devices are designed towards compactness, the antenna installed inside is adjacent to large-size metallic components such as the battery, the mainboard and the LCD panel due to small room inside the housing. In the conventional antenna, the feed points and the radiation units are disposed on the same surface and, therefore, the conventional antenna is interfered due to metallic shielding to adversely affect signal transceiving. Moreover, the conventional antenna generally uses L-like grounding, which results in limited operating bandwidth.

Therefore, there exists a need in providing an antenna wherein the radiation units do not directly face the metallic component such as a battery module or other similar metallic component to prevent the radiation units from being interfered due to metallic shielding.

SUMMARY OF THE INVENTION

It is one object of the present invention to provide an antenna capable of overcoming interference with surrounding metallic components.

In order to achieve the foregoing object, in one embodiment, the present invention provides an antenna, comprising: a substrate with a first surface and a second surface that are symmetric; a first radiation unit, disposed on the first surface of the substrate; an insulating unit, disposed on the first surface of the substrate so that the first radiation unit is disposed between the substrate and the insulating unit; a first feed point, formed on the second surface of the substrate and penetrating the substrate so as to be electrically connected to the first radiation unit; a first axe-like grounding unit, disposed coplanar with the first radiation unit so that one end of the first axe-like grounding unit is electrically connected to the first radiation unit; a first gap, formed between the first radiation unit and the first axe-like grounding unit; and a second feed point, formed on the second surface of the substrate and penetrating the substrate so as to be electrically connected to the first axe-like grounding unit; wherein the second surface of the substrate is adjacent to at least a metallic component.

In another embodiment, the present invention further provides an antenna, comprising: a substrate with two symmetric surfaces; a first radiation unit, disposed on one surface of the two symmetric surfaces; a first feed point, formed un-coplanar with the first radiation unit on the other surface of the two symmetric surfaces and penetrating the substrate so as to be electrically connected to the first radiation unit; a first axe-like grounding unit, disposed coplanar with the first radiation unit on the substrate so that one end of the first axe-like grounding unit is electrically connected to the first radiation unit; a first gap, formed between the first radiation unit and the first axe-like grounding unit; a second feed point, disposed coplanar with the first feed point on the substrate and penetrating the substrate so as to be electrically connected to the first axe-like grounding unit; and wherein the first feed point and the second feed point are adjacent to at least a metallic component.

Preferably, in the present invention, the first surface and the second surface are disposed on the two symmetric surfaces on the substrate, respectively.

Preferably, in the present invention, the first surface and the second surface are two un-coplanar symmetric surfaces.

Preferably, in the present invention, the antenna further comprises at least a matching unit to achieve impedance matching of the first radiation unit by adjusting the size of the matching unit.

Preferably, in the present invention, the first axe-like grounding unit and the matching unit are formed as one.

Preferably, in the present invention, the antenna further comprises: a second radiation unit, disposed on the first surface of the substrate and between the substrate and the insulating unit; a third feed point, formed on the second surface of the substrate and penetrating the substrate so as to be electrically connected to the second radiation unit; a second axe-like grounding unit, disposed coplanar with the second radiation unit so that one end of the second axe-like grounding unit is electrically connected to the second radiation unit; a second gap, formed between the second radiation unit and the second axe-like grounding unit; and a fourth feed point, formed on the second surface of the substrate and penetrating the substrate so as to be electrically connected to the second axe-like grounding unit.

Preferably, in the present invention, the antenna further comprises at least a matching unit to achieve impedance matching between the first radiation unit and the matching unit by adjusting the size of the matching unit.

Preferably, in the present invention, the first feed point penetrates the substrate so as to be electrically connected to the joint of the first radiation unit and the first axe-like grounding unit.

Preferably, in the present invention, the thin pole end of the first axe-like grounding unit is electrically connected to the first radiation unit and is extended to connect a large-area blade end to enhance the operating bandwidth of the first radiation unit.

Preferably, in the present invention, the first gap is formed between the first radiation unit and the thin pole end of the first axe-like grounding unit.

Preferably, in the present invention, the third feed point penetrates the substrate so as to be electrically connected to the joint of the second radiation unit and the second axe-like grounding unit.

Preferably, in the present invention, the thin pole end of the second axe-like grounding unit is electrically connected to the second radiation unit and is extended to connect a large-area blade end to enhance the operating bandwidth of the second radiation unit.

Preferably, in the present invention, the second gap is formed between the second radiation unit and the thin pole end of the second axe-like grounding unit.

Preferably, in the present invention, the first radiation unit and the first axe-like grounding unit are formed as one.

Preferably, in the present invention, the first radiation unit, the first axe-like grounding unit, the second radiation unit and the second axe-like grounding unit are formed as one.

Preferably, in the present invention, the first axe-like grounding unit is electrically connected to the second axe-like grounding unit.

Preferably, in the present invention, the first axe-like grounding unit and the second axe-like grounding unit are formed as one.

Preferably, in the present invention, the matching unit is disposed at the joint where the first axe-like grounding unit and the second axe-like grounding unit are electrically connected.

Preferably, in the present invention, the first axe-like grounding unit, the second axe-like grounding unit and the matching unit are formed as one.

Preferably, in the present invention, the first radiation unit and the second radiation unit have different operating frequencies.

Preferably, in the present invention, the substrate comprises a connecting portion capable of connecting the antenna and an electronic device.

Preferably, in the present invention, the substrate is a printed circuit board.

In the present invention, the feed points are disposed on the second surface of the substrate and the radiation units are disposed on the first surface of the substrate so that the radiation units do not directly face the metallic component such as a battery module in an electronic device or other similar metallic component to prevent the radiation units from being interfered due to metallic shielding.

BRIEF DESCRIPTION OF THE DRAWINGS

The objects, spirits and advantages of the preferred embodiment of the present invention will be readily understood by the accompanying drawings and detailed descriptions, wherein.

DETAILED DESCRIPTION OF THE PREFERRED EMBODIMENT

The present invention can be exemplified by the preferred embodiment as described hereinafter.

Figure 1:
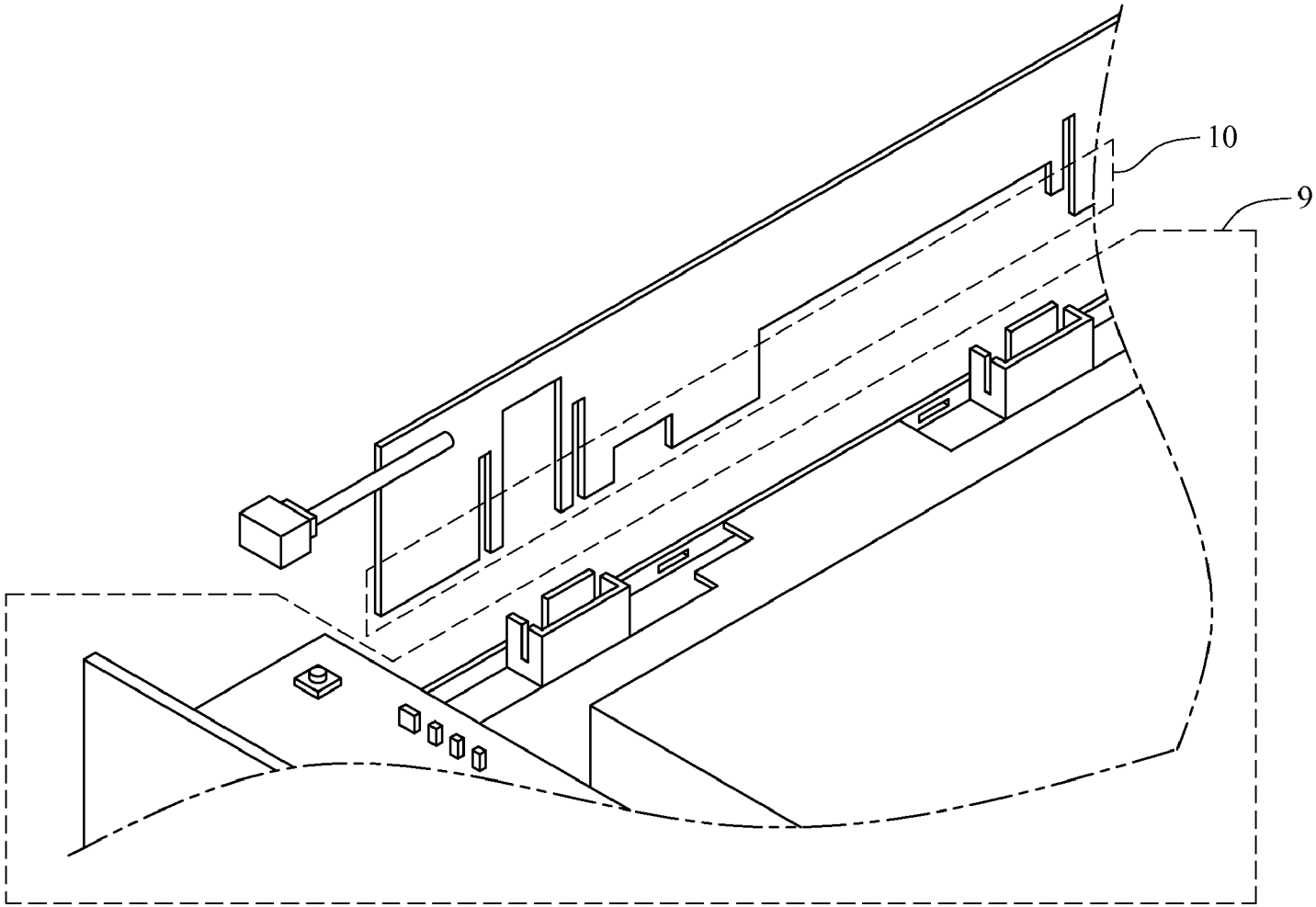
FIG. 1 is a 3-D view of an antenna according to the preferred embodiment of the present invention.
Figure 2:
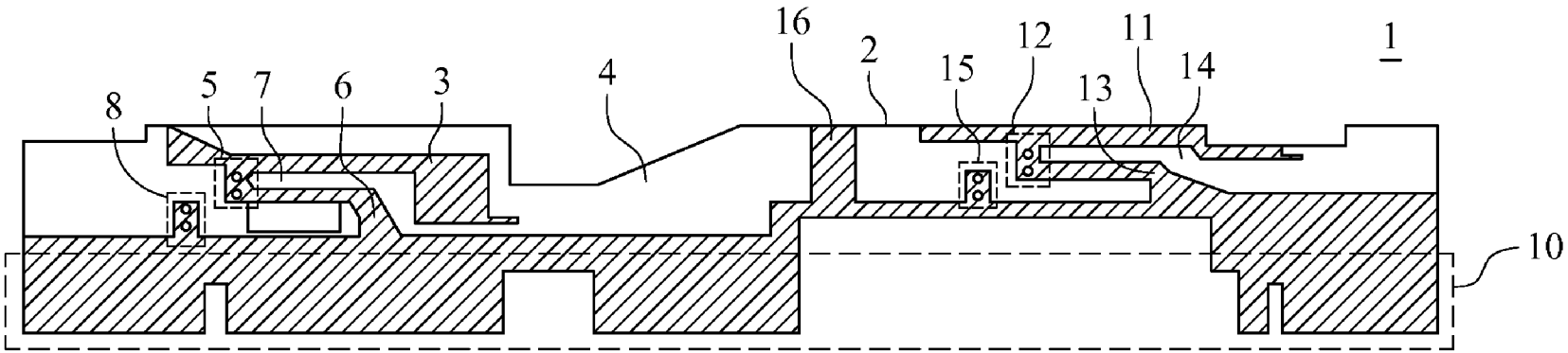
FIG. 2 is a rear view of an antenna according to the preferred embodiment of the present invention.
Figure 3:
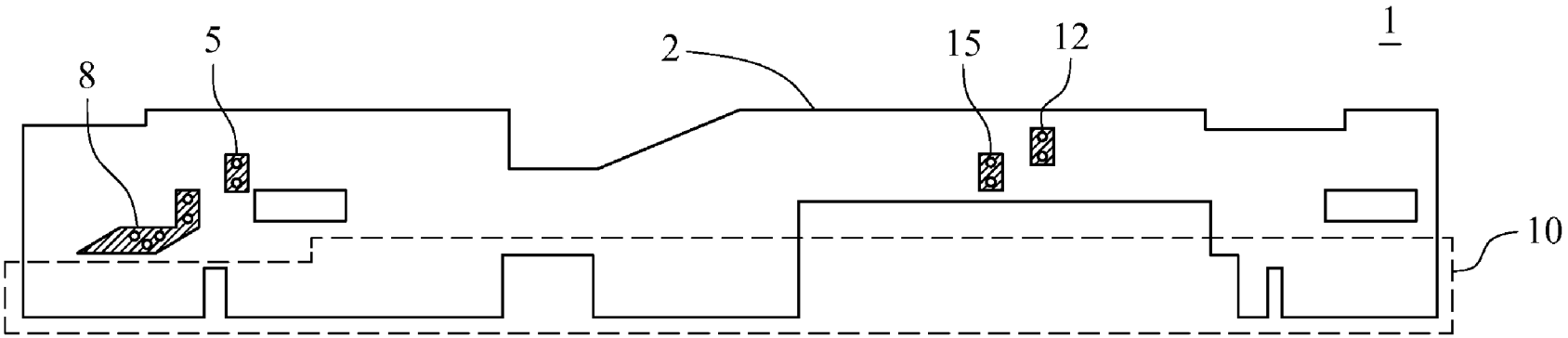
FIG. 3 is a front view of an antenna according to the preferred embodiment of the present invention.

FIG. 1, FIG. 2 and FIG. 3 show a 3-D view, a rear view and a front view, respectively, of an antenna according to the preferred embodiment of the present invention. Referring to FIG. 1, FIG. 2 and FIG. 3, the antenna 1 comprises: a substrate 2 with a first surface and a second surface that are symmetric; a first radiation unit 3, disposed on the first surface of the substrate 3; an insulating unit 4, disposed on the first surface of the substrate 2 so that the first radiation unit 3 is disposed between the substrate 2 and the insulating unit 4; a first feed point 5, formed on the second surface of the substrate 2 and penetrating the substrate 2 so as to be electrically connected to the first radiation unit 3; a first axe-like grounding unit 6, disposed coplanar with the first radiation unit 3 so that one end of the first axe-like grounding unit 6 is electrically connected to the first radiation unit 3 to enhance the operating bandwidth of the first radiation unit 3; a first gap 7, formed between the first radiation unit 3 and the first axe-like grounding unit 6; and a second feed point 8, formed on the second surface of the substrate 2 and penetrating the substrate 2 so as to be electrically connected to the first axe-like grounding unit 6; wherein the second surface of the substrate 2 is adjacent to at least a metallic component (exemplified by but not limited to a battery, a mainboard or a display panel). Generally, to enable the antenna to perform optimally and reduce the manufacturing cost, it is preferable that the first radiation unit 3 and the first axe-like grounding unit 6 are formed as one metallic structure. Moreover, since the antenna is generally disposed inside an electronic device 9 (exemplified by but not limited to a mobile Internet device), it is preferable that the substrate 2 comprises a connecting portion 10 to connect the antenna and the electronic device 9. As shown in FIG. 1, the first feed point 5 and the second feed point 8 face inwards, while the first radiation unit 3 faces outwards. Therefore, the first radiation unit 3 does not directly face the battery module or other metallic component of the electronic device 9 to prevent the first radiation unit 3 from being interfered due to metallic shielding.

Further referring to FIG. 1, FIG. 2 and FIG. 3, the present invention further provides an antenna 1, comprising: a substrate 2 with two symmetric surfaces; a first radiation unit 3, disposed on one surface of the two symmetric surfaces; a first feed point 5, formed un-coplanar with the first radiation unit 3 on the other surface of the two symmetric surfaces and penetrating the substrate 2 so as to be electrically connected to the first radiation unit 3; a first axe-like grounding unit 6, disposed coplanar with the first radiation unit 3 on the substrate 2 so that one end of the first axe-like grounding unit 6 is electrically connected to the first radiation unit 3, wherein the first radiation unit 3 and the first axe-like grounding unit 6 are preferably formed as one; a first gap 7, formed between the first radiation unit 3 and the first axe-like grounding unit 6; a second feed point 8, disposed coplanar with the first feed point 5 on the substrate 2 and penetrating the substrate 2 so as to be electrically connected to the first axe-like grounding unit 6; wherein the first feed point 5 and the second feed point 8 are adjacent to at least a metallic component (exemplified by but not limited to a battery, a mainboard or a display panel). Generally, to enable the antenna to perform optimally, it is preferable that the antenna 1 further comprises an insulating unit 4 disposed on the one surface of the two symmetric surfaces so that the first radiation unit 3 is disposed between the substrate 2 and the insulating unit 4. Preferably, the antenna 1 further comprises at least a matching unit 16 to achieve impedance matching of the first radiation unit 3 by adjusting the size of the matching unit 16. Moreover, since the antenna is generally disposed inside an electronic device 9 (exemplified by but not limited to a mobile Internet device), it is preferable that the substrate 2 comprises a connecting portion 10 to connect the antenna and the electronic device 9.

To make the present invention more applicable, the antenna 1 further comprises: a second radiation unit 11, disposed on the first surface of the substrate 2 and between the substrate 2 and the insulating unit 4; a third feed point 12, formed on the second surface of the substrate 2 and penetrating the substrate 2 so as to be electrically connected to the second radiation unit 11; a second axe-like grounding unit 13, disposed coplanar with the second radiation unit 11 so that one end of the second axe-like grounding unit 13 is electrically connected to the second radiation unit 11; a second gap 14, formed between the second radiation unit 11 and the second axe-like grounding unit 13; and a fourth feed point 15, formed on the second surface of the substrate 2 and penetrating the substrate 2 so as to be electrically connected to the second axe-like grounding unit 13. Generally, to enable the antenna to perform optimally and reduce the manufacturing cost, it is preferable that the first radiation unit 3, the first axe-like grounding unit 6, the second radiation unit 11 and the second axe-like grounding unit 13 are formed as one metallic structure so as to achieve a dual-band antenna. For example, the operating frequency of the first radiation unit is 2.3 GHz to 2.5 GH, while the operating frequency of the second radiation unit is 4.8 GHz to 6 GHz. In order to prevent the antenna from being interfered, preferably the antenna further comprises at least a matching unit 16 to achieve impedance matching between the first radiation unit 3 and the second radiation unit 11 by adjusting the size of the matching unit 16. Preferably, the first radiation unit 3, the second radiation unit 11 and the matching unit 16 are formed as one so that the antenna exhibits optimal performance with reduced manufactured cost. The dual-band antenna is presented as in FIG. 1, wherein the first feed point 5, the second feed point 8, the third feed point 12 and the fourth feed point 15 face inwards, while the first radiation unit 3 and the second radiation unit 11 face outwards. Therefore, the first radiation unit 3 and the second radiation unit 11 do not directly face the battery module or other metallic component of the electronic device 9 to prevent the first radiation unit 3 and the second radiation unit 11 from being interfered due to metallic shielding.

Accordingly, the present invention provides an antenna wherein the radiation units do not directly face the metallic component such as a battery module or other similar metallic component to prevent the radiation units from being interfered due to metallic shielding. Therefore, the present invention is novel, useful and non-obvious.

Although this invention has been disclosed and illustrated with reference to particular embodiments, the principles involved are susceptible for use in numerous other embodiments that will be apparent to persons skilled in the art. This invention is, therefore, to be limited only as indicated by the scope of the appended claims.

What is claimed is:

1. An antenna, comprising:

a substrate with a first surface and a second surface that are symmetric;

a first radiation unit, disposed on the first surface of the substrate;

a first feed point, formed on the second surface of the substrate and penetrating the substrate so as to be electrically connected to the first radiation unit;

a first L-shaped grounding unit comprising a bar-shaped element connected with an irregular polygon-shaped element, the first L-shaped grounding unit disposed coplanar with the first radiation unit so that one end of the first L-shaped grounding unit is electrically connected to the first radiation unit, wherein the width of one end of the first L-shape grounding unit is larger than the width of the other end of the first L-shaped grounding unit for increasing operational bandwidth of the first radiation unit;

a first gap, formed between the first radiation unit and the first L-shaped grounding unit; and a second feed point, formed on the second surface of the substrate and penetrating the substrate so as to be electrically connected to the first L-shaped grounding unit;

wherein the second surface of the substrate is adjacent to at least a metallic component.

2. The antenna as recited in claim 1, further comprising:

a second radiation unit, disposed on the first surface of the substrate;

a third feed point, formed on the second surface of the substrate and penetrating the substrate so as to be electrically connected to the second radiation unit;

a second L-shaped grounding unit, disposed coplanar with the second radiation unit so that one end of the second L-shaped grounding unit is electrically connected to the second radiation unit, wherein the width of one end of the second L-shaped grounding unit is larger than the width of the other end of the second L-shaped grounding unit;

a second gap, formed between the second radiation unit and the second L-shaped grounding unit; and a fourth feed point, formed on the second surface of the substrate and penetrating the substrate so as to be electrically connected to the second L-shaped grounding unit.

3. The antenna as recited in claim 2, further comprising at least a matching unit so as to achieve impedance matching between the first radiation unit and the second radiation unit.

4. The antenna as recited in claim 1, wherein the first radiation unit and the first L-shaped grounding unit are formed as one.

5. The antenna as recited in claim 2, wherein the first radiation unit, the first L-shaped grounding unit, the second radiation unit and the second L-shaped grounding unit are formed as one.

6. The antenna as recited in claim 2, wherein the first L-shaped grounding unit and the second L-shaped grounding unit are formed as one.

7. The antenna as recited in claim 3, wherein the first L-shaped grounding unit, the second L-shaped grounding unit and the matching unit are formed as one.

8. The antenna as recited in claim 1, wherein the substrate comprises a connecting portion capable of connecting the antenna and an electronic device.

9. The antenna as recited in claim 8, wherein the electronic device is a mobile Internet device.

10. The antenna as recited in claim 1, wherein the metallic component is a battery, a mainboard or a display panel.

11. The antenna as recited in claim 2, wherein the first radiation unit and the second radiation unit have different operating frequencies.

12. An antenna, comprising:

a substrate with two symmetric surfaces;

a first radiation unit, disposed on one surface of the two symmetric surfaces;

a first feed point, formed un-coplanar with the first radiation unit on the other surface of the two symmetric surfaces and penetrating the substrate so as to be electrically connected to the first radiation unit;

a first L-shaped grounding unit comprising a bar-shaped element connected with an irregular polygon-shaped element, disposed coplanar with the first radiation unit on the substrate so that one end of the first L-shaped grounding unit is electrically connected to the first radiation unit, wherein the width of one end of the first L-shape grounding unit is larger than the width of the other end of the first L-shaped grounding unit for increasing operational bandwidth of the first radiation unit;

a first gap, formed between the first radiation unit and the first L-shaped grounding unit;

a second feed point, disposed coplanar with the first feed point on the substrate and penetrating the substrate so as to be electrically connected to the first L-shaped grounding unit;

a second L-shaped grounding unit, wherein the width of one end of the second L-shaped grounding unit is larger than width of the other end of the second L-shaped grounding unit; and wherein the first feed point and the second feed point are adjacent to at least a metallic component.

13. The antenna as recited in claim 12, further comprising an insulating unit disposed on the one surface of the two symmetric surfaces so that the first radiation unit is disposed between the substrate and the insulating unit.

14. The antenna as recited in claim 12, further comprising at least a matching unit so as to achieve impedance matching of the first radiation unit.

15. The antenna as recited in claim 12, wherein the first radiation unit and the first L-shaped grounding unit are formed as one.

16. The antenna as recited in claim 14, wherein the first L-shaped grounding unit and the matching unit are formed as one.

17. The antenna as recited in claim 12, wherein the substrate comprises a connecting portion capable of connecting the antenna and an electronic device.

18. The antenna as recited in claim 17, wherein the electronic device is a mobile Internet device.

19. The antenna as recited in claim 12, wherein the metallic component is a battery, a mainboard or a display panel.

* * * * *